US012274355B2

(12) United States Patent
Berhault

(10) Patent No.: US 12,274,355 B2
(45) Date of Patent: Apr. 15, 2025

(54) APPLICATOR FOR APPLYING A PRODUCT TO THE EYELASHES AND/OR EYEBROWS

(71) Applicant: L'OREAL, Paris (FR)

(72) Inventor: Alain Berhault, Clichy (FR)

(73) Assignee: L'OREAL, Paris (FR)

( * ) Notice: Subject to any disclaimer, the term of this patent is extended or adjusted under 35 U.S.C. 154(b) by 303 days.

(21) Appl. No.: 17/802,317

(22) PCT Filed: May 10, 2021

(86) PCT No.: PCT/EP2021/062356
§ 371 (c)(1),
(2) Date: Aug. 25, 2022

(87) PCT Pub. No.: WO2021/233723
PCT Pub. Date: Nov. 25, 2021

(65) Prior Publication Data

US 2023/0098839 A1 Mar. 30, 2023

(30) Foreign Application Priority Data

May 18, 2020 (FR) ..... 2004941

(51) Int. Cl.
*A45D 40/26* (2006.01)
*A46B 9/02* (2006.01)
(Continued)

(52) U.S. Cl.
CPC ..... *A46B 9/021* (2013.01); *A46B 9/026* (2013.01); *A46D 1/0238* (2013.01); *A45D 34/046* (2013.01); *A46B 2200/1053* (2013.01)

(58) Field of Classification Search
CPC .... A45D 40/262; A45D 40/265; A46B 9/021; A46B 2200/1053; A46D 1/0238
See application file for complete search history.

(56) References Cited

U.S. PATENT DOCUMENTS

2008/0023020 A1* 1/2008 Gueret ..... A46B 9/021 132/218
2017/0079410 A1 3/2017 Crapet et al.

FOREIGN PATENT DOCUMENTS

CN 206413935 U 8/2017
FR 3066565 A1 12/2014
(Continued)

OTHER PUBLICATIONS

International Search Report (ISR) for PCT/EP2021/062356 mailed Jul. 16, 2021 (3 pages).
(Continued)

*Primary Examiner* — Rachel R Steitz
(74) *Attorney, Agent, or Firm* — Shumaker, Loop & Kendrick, LLP

(57) ABSTRACT

Applicator for applying a product (F) to the eyelashes and/or eyebrows. The applicator includes an applicator member having a core extending along a longitudinal axis (Y), spikes that are carried by the core that have, in face-on view when viewed along the longitudinal axis (Y) of the core (10), a substantially triangular shape over at least 50% of their height (h), with a side that is oriented substantially radially, and have a cross section at the base of the spike taken perpendicularly to this side, satisfying the relationship e/L of between 0.4 and 0.6, where e denotes the thickness of the section measured in the direction of the longitudinal axis (Y) of the core and L denotes the width of the section measured in a direction perpendicular to the longitudinal axis (Y) of the core.

19 Claims, 9 Drawing Sheets

(51) Int. Cl.
*A46D 1/00* (2006.01)
*A45D 34/04* (2006.01)

(56) References Cited

FOREIGN PATENT DOCUMENTS

| | | | |
|---|---|---|---|
| WO | 2012/080936 | A2 | 6/2012 |
| WO | 2014/195914 | A1 | 12/2014 |

OTHER PUBLICATIONS

Written Opinion (WO) for PCT/PCT/EP2021/062356 mailed Jul. 16, 2021 (7 pages).

* cited by examiner

APPLICATOR FOR APPLYING A PRODUCT TO THE EYELASHES AND/OR EYEBROWS

TECHNICAL FIELD

The present invention relates to applicators for applying a cosmetic, makeup or care, product to the eyelashes and/or eyebrows, in particular mascara, and to packaging and application devices having such applicators.

The invention relates more particularly to applicators made of plastics material, in particular by injection moulding.

BACKGROUND

The applicators used for making up the eyelashes or eyebrows usually have an applicator member mounted at the end of a stem, which is connected at its other end to a gripping member.

The applicator member is conventionally loaded with product by being dipped into a container provided with a wiping member Which has a lip for wiping the stem as it is withdrawn from the container and which generally defines an orifice of circular section, the diameter of which corresponds substantially to that of the stem.

The behaviour of the applicator member as it passes through the wiper depends on numerous factors, such as the shape and nature of the lip of the wiper, the geometry of the applicator member and the choice of the material(s) of which it is made.

Excessive wiping of the applicator member is likely to make it difficult to withdraw the latter from the container and causes the applicator member to be insufficiently loaded, obliging the user to frequently dip the applicator back into the container.

By contrast, insufficient wiping leaves excess product on the applicator member, which is difficult to manage and can result in the presence of clumps of product on the eyelashes, which are thus poorly separated.

Furthermore, the applicator member carries application elements constituted of spikes, the arrangement of which has an influence on the behaviour of the applicator as it is withdrawn from the container.

Spikes that are very flexible will easily deform on passing through the wiper, making withdrawal easier, but their flexibility: means that it will be more difficult for them to comb the eyelashes suitably daring application and to smooth the product over the surface thereof. In addition, the wiper will tend to leave less product on the applicator member.

On the other hand, rigid spikes will tend to deform less when the applicator member passes through, resulting in greater loading of the applicator member with product and a better ability to comb and separate the eyelashes.

The design of the applicator thus often results from a compromise that has to be made between various requirements that are sometimes contradictory as regards the quantity of product that is left on the applicator member for makeup application, the desired behaviour on withdrawing the applicator member and the capacity for separating the eyelashes.

The application FR3006565 describes a brush made of plastics material having rows of spikes that each have, in face-on view, in elevation, the overall shape of a shark fin, with, on one side, a radially oriented straight edge and, on the opposite side, a convex rounded edge, thereby resulting in a relatively wide base.

SUMMARY

There is a need to further improve applicators for applying a product, in particular mascara, to the eyelashes and/or eyebrows, in order in particular to allow easy withdrawal of the applicator member from the container while maintaining performance in terms of satisfactory, or even improved, application and making up.

The invention aims to meet this objective and the subject thereof, according to one of its aspects, is an applicator for applying a product to the eyelashes and/or eyebrows, having an applicator member having:

- a core extending along a longitudinal axis,
- spikes that are carried by the core, have, in face-on view when viewed along the longitudinal axis of the core, a substantially triangular shape over at least 50% of their height, with a side that is oriented substantially radially, and have a cross section at the base of the spike taken perpendicularly to this side, satisfying the relationship e/L of between 0.4 and 0.6, where e denotes the thickness of the section measured in the direction of the longitudinal axis of the core and L denotes the width of the section measured in a direction perpendicular to the longitudinal axis of the core.

The particular shape of the spikes and the orientation thereof relative to the longitudinal axis of the core gives them great flexibility with regard to a force exerted in the direction of the longitudinal axis of the core, consequently making it easier to pass through the wiping member, thereby giving the user an increased sensation of gentleness on withdrawal.

Nevertheless, on account of their width, the spikes retain a degree of rigidity in the transverse direction, resulting in satisfactory properties of combing and separating the eyelashes.

The "longitudinal axis of the core" denotes the line connecting all of the centres of mass of the cross sections of the core. This longitudinal axis may be a central axis, or even an axis of symmetry for the core, in particular when the core has a circular cross section or a cross section in the overall shape of a regular polygon.

The longitudinal axis of the core may be rectilinear or may have one or more curves between the distal and proximal ends of the core. Preferably, the longitudinal axis of the core is rectilinear and coincident with the longitudinal axis of a stem supporting the applicator member.

The expression "substantially triangular" should be understood as meaning that the shape is triangular or approximately triangular, with sides that differ from those of an imaginary triangle that is most similar by a relative difference that is always less than 10%, better still than 5%, even better still than 3%, this relative difference being defined by the ratio f/d, f denoting the distance between the side of the approximate triangle and that of the similar imaginary triangle, and d denoting the length of the corresponding side of the similar imaginary triangle. Preferably, the side of the part with a substantially triangular shape that extends radially is rectilinear, while the opposite side, which extends obliquely, may be rectilinear or substantially rectilinear. In a preferred embodiment, the spikes have a triangular shape over at least 50% of their height, better still over at least 75% of their height, in face-on view when viewed along the longitudinal axis of the core.

Preferably, the ratio e/L is between 0.45 and 0.55, in particular equal to 0.5.

The thickness e is advantageously between 0.15 mm and 0.35 mm at the base of the spike, better still between 0.2 and 0.3 mm. Such a thickness makes it possible to achieve a good compromise between mechanical integrity of the spike and flexibility when the applicator member passes through the wiper, for plastics materials that are commonly used for manufacturing the applicator member, such as thermoplastic elastomers, for example.

The width L is preferably between 0.5 mm and 0.75 mm at the base of the spike. Such a width makes it possible to achieve rigidity suitable for good separation of the eyelashes and/or eyebrows.

Preferably, the spikes have, at their base, a cross section of convex shape around at least a part of their perimeter, in particular a planar-convex shape, with a planar side and an opposite side of convex shape. The planar side is preferably oriented parallel to the longitudinal axis of the core, while the convex side extends preferably in a direction perpendicular to the longitudinal axis of the core.

According to a preferred embodiment, the spikes have, at their base, a cross section of ogival shape. In particular, the cross section may have a straight base parallel to the longitudinal axis of the core. Such a shape helps in the achievement of a good compromise between flexibility of the spikes in the direction of the longitudinal axis of the core and rigidity in the transverse direction.

The height of the spikes is preferably between 2 and 6 mm, better still between 2.5 mm and 4.5 mm. The choice of such a height promotes the deformability of the spikes in the direction of the longitudinal axis of the core, while maintaining good rigidity in the transverse direction.

Preferably, said substantially triangular shape extends over at least 75%, better still at least 80%, even better still at least 90% of the total height of the spikes.

The spikes preferably have a substantially planar face, parallel to the longitudinal axis of the core, which extends substantially radially. This planar face defines the side, extending radially in face-on view, of the spike, as mentioned above, and the planar side of the abovementioned planar-convex cross section.

The base of a spike is preferably at an angle of between 5° and 10° as seen from the tip thereof. Thus, the spike has a relatively tapered shape.

Said substantially triangular shape may have an inclined side, preferably rectilinear, attached to the core by a portion with a steeper gradient, resulting in a break in gradient at a junction point. Such a break in gradient makes it possible to provide a larger space in the circumferential direction between the spikes of adjacent rows at their base, which facilitates demoulding and may make it possible to form a reserve of product in contact with the core.

The core may have a slightly conical shape, converging towards the distal end of the applicator member. The spikes closest to the distal end of the applicator member may have such a break in gradient over a greater height than the spikes further away from this end. From a certain distance, the spikes may no longer have such a break in gradient, the rectilinear oblique side of the part of triangular shape continuing as far as the core.

The applicator member may have a length of between 15 mm and 30 mm, better still between 25 mm and 30 mm.

The spikes are preferably arranged in rows, and the spikes in one and the same row may be at least partially superposed in face-on view, when the applicator member is viewed along the longitudinal axis of the core. The spikes in one and the same row may in particular have all their radial rectilinear sides contained in one and the same radial plane.

The spikes in one row are advantageously offset axially relative to those in the adjacent rows. The spikes in one row may thus be disposed in a staggered manner with respect to those in the adjacent row. This optimizes the passage of the eyelashes between the spikes and the smoothing of the product over the surface thereof.

The distance along the longitudinal axis of the core between two consecutive spikes in one and the same row is preferably between 0.5 mm and 0.7 mm. This distance is measured between the tips of the spikes.

The applicator member preferably has an envelope surface, defined by the free ends of the spikes, inscribed in a circle with a diameter that varies between 4 and 6 mm, better still between 4.5 mm and 5.1 mm.

The envelope surface may have a cross section which is substantially in the form of a cylinder of revolution along more than half of its length.

The longitudinal axis of the core is preferably rectilinear.

The number of spikes in a row may be greater than or equal to 10, better still between 15 and 25.

The number of rows may be between 6 and 20, better still between 12 and 20, even better still between 14 and 20, the rows preferably being distributed uniformly all around the longitudinal axis of the applicator member.

The applicator member may be made from one or more plastics materials. Preferably, to produce the spikes, use is made of a plastics material having a Shore hardness of between 35 and 60 Shore D.

A further subject of the invention, according to another of its aspects, is a packaging and application device having an applicator according to the invention and a container containing the product to be applied.

A further subject of the invention, according to another of its aspects, is a method for making up and/or caring for the eyelashes and/or eyebrows, involving the application to the eyelashes and/or eyebrows of a product by means of the applicator of the device according to the invention.

BRIEF DESCRIPTION OF THE DRAWINGS

The invention may be understood better from reading the following detailed description of non-limiting implementation examples thereof and from studying the appended drawing, in which.

DETAILED DESCRIPTION

Figure 1:
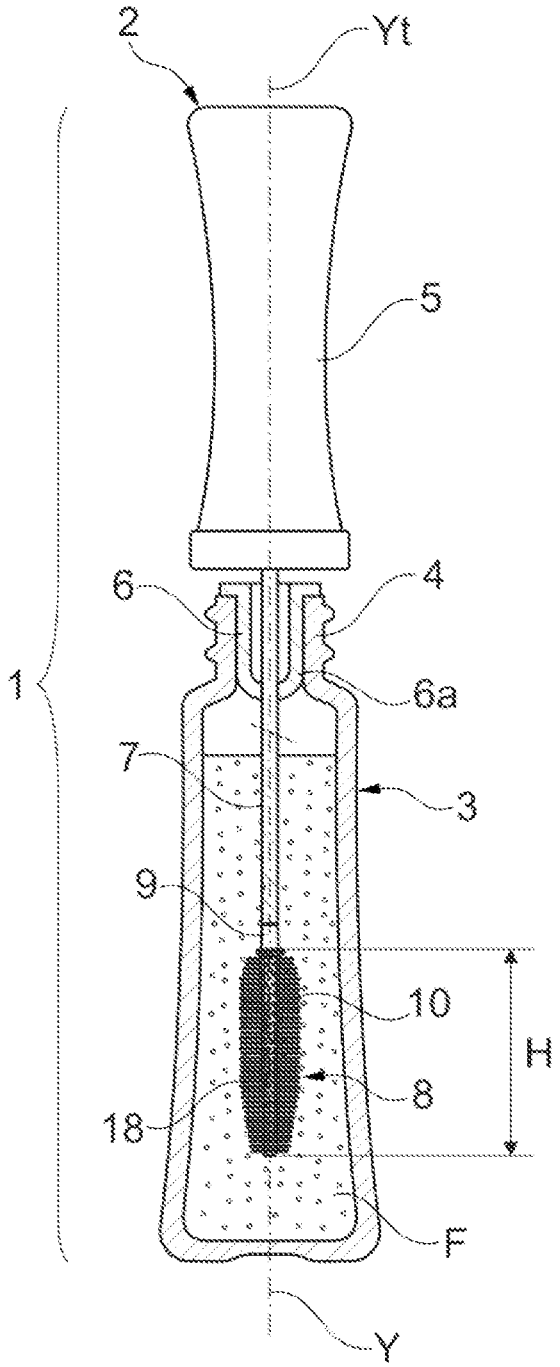
FIG. 1 schematically shows, in partial longitudinal section, a packaging and application device according to the invention.

FIG. 1 shows a packaging and application device 1 produced in accordance with the invention, having an applicator 2 and an associated container 3 containing a product F to be applied to the eyelashes and/or the eyebrows, for example mascara or a care product.

In the example in question, the container 3 has a threaded neck 4 and the applicator 2 has a gripping member 5, which also forms a closure cap for the container 3. Said cap is designed to be fastened to the neck 4 so as to close the container 3 in a sealed manner when not in use. The applicator 2 has a stem 7 of longitudinal axis $Y_t$, which is attached to the closure cap 5 at its upper end and to an applicator member 8 according to the invention at its lower end. The latter has a core 10 that carries spikes 18 that extend from the core 10 and, in the example in question, all around the latter.

The container 3 also has a wiping member 6, which is for example snap-fastened in the neck 4 or fastened in the latter by any other means.

In the example in question, this wiping member 6 has a lip designed to wipe the stem 7 and the applicator member 8 when the applicator 2 is withdrawn from the container 3. The lip defines a wiping orifice 6*a* having a diameter adapted to that of the stem 7.

The wiping member 6 may be made of an elastomer, in a conventional manner.

The wiping orifice 6*a* may have a circular shape, possibly with slits. The diameter of the wiping orifice 6*a* is, for example, between 2.5 and 6 mm, depending on the diameter of the stem 7. The lip of the wiping member 6 may optionally have waves, allowing the wiping orifice 6*a* to widen more easily when the applicator member 8 passes through.

The wiping member 6 may also be adjustable, if appropriate.

In the example illustrated, the stem 7 has a circular cross section, but it would not constitute a departure from the scope of the present invention if the stem 7 were to have a different section, it then being possible to fasten the cap 5 to the container 3 in some other way than by screwing.

Preferably, and as in the example in question, the longitudinal axis $Y_t$ of the stem 7 is rectilinear and coincident with the longitudinal axis of the container 3 when the applicator 2 is in place thereon, but it would not constitute a departure from the scope of the present invention if the stem 7 were not rectilinear, forming for example an elbow.

If need be, the stem 7 may have an annular narrowing at its portion that is positioned opposite the lip of the wiping member 6, so as not to mechanically stress the latter unduly during storage.

Figure 2:
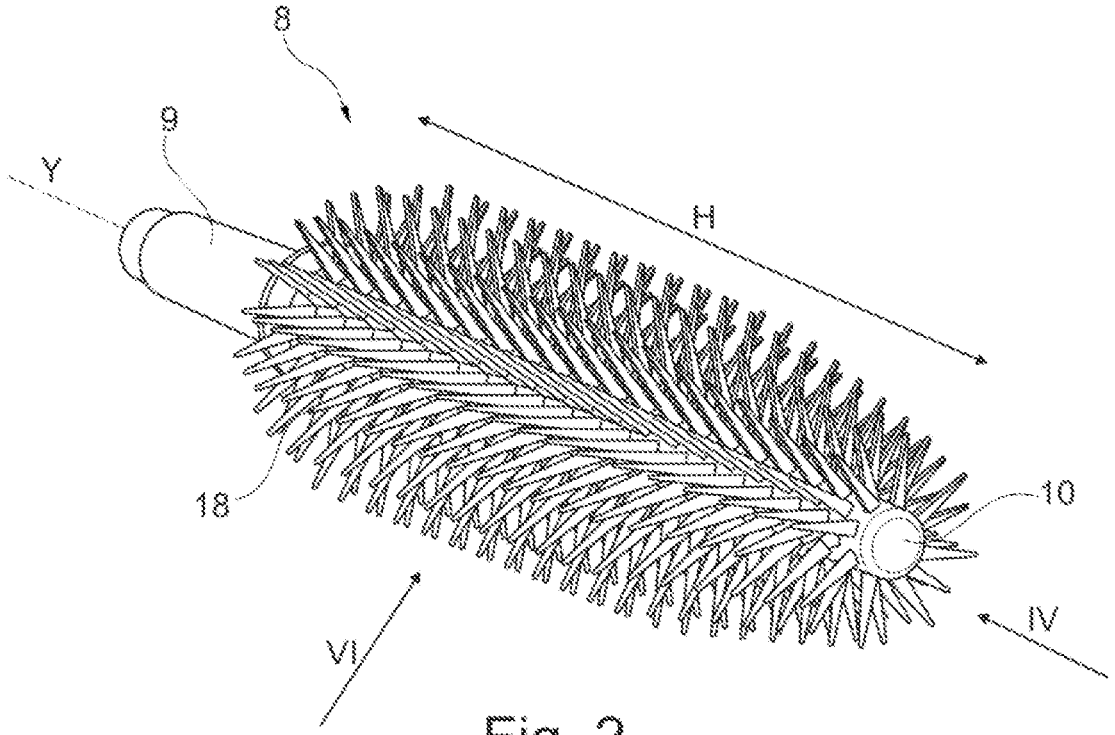
FIG. 2 shows a perspective view of an example of an applicator member according to the invention, on its own.

The applicator member 8 is fastened to the stem 7 by any means, and in particular by force-fitting, snap-fastening, adhesive bonding, welding, stapling or crimping, preferably in a corresponding housing provided at the end of the stem 7. As illustrated in FIG. 2, the applicator member 8 may have, at its proximal end, an end piece 9 for fastening it in this housing.

The applicator member 8 is made of thermoplastic material, preferably by injection moulding, but the invention is not limited to a particular way of producing the applicator member.

The spikes 18 may be moulded with the core 10, from the same material or from a different material.

As is illustrated in FIG. 2, the core 10 has an elongate shape along a longitudinal axis Y. The latter is rectilinear in the example in question but may, as a variant, have some other shape, in particular be curved. The longitudinal axis Y is preferably an axis of symmetry for the core, better still for the applicator member as a whole.

The core 10 may have a cross section that varies or does not vary along its longitudinal axis. In the example in FIG. 2, the part of the core 10 that carries the spikes has a conical overall shape with a diameter that decreases towards the distal end of the applicator member 8.

The length H is for example between 15 mm and 30 mm.

Figure 5:
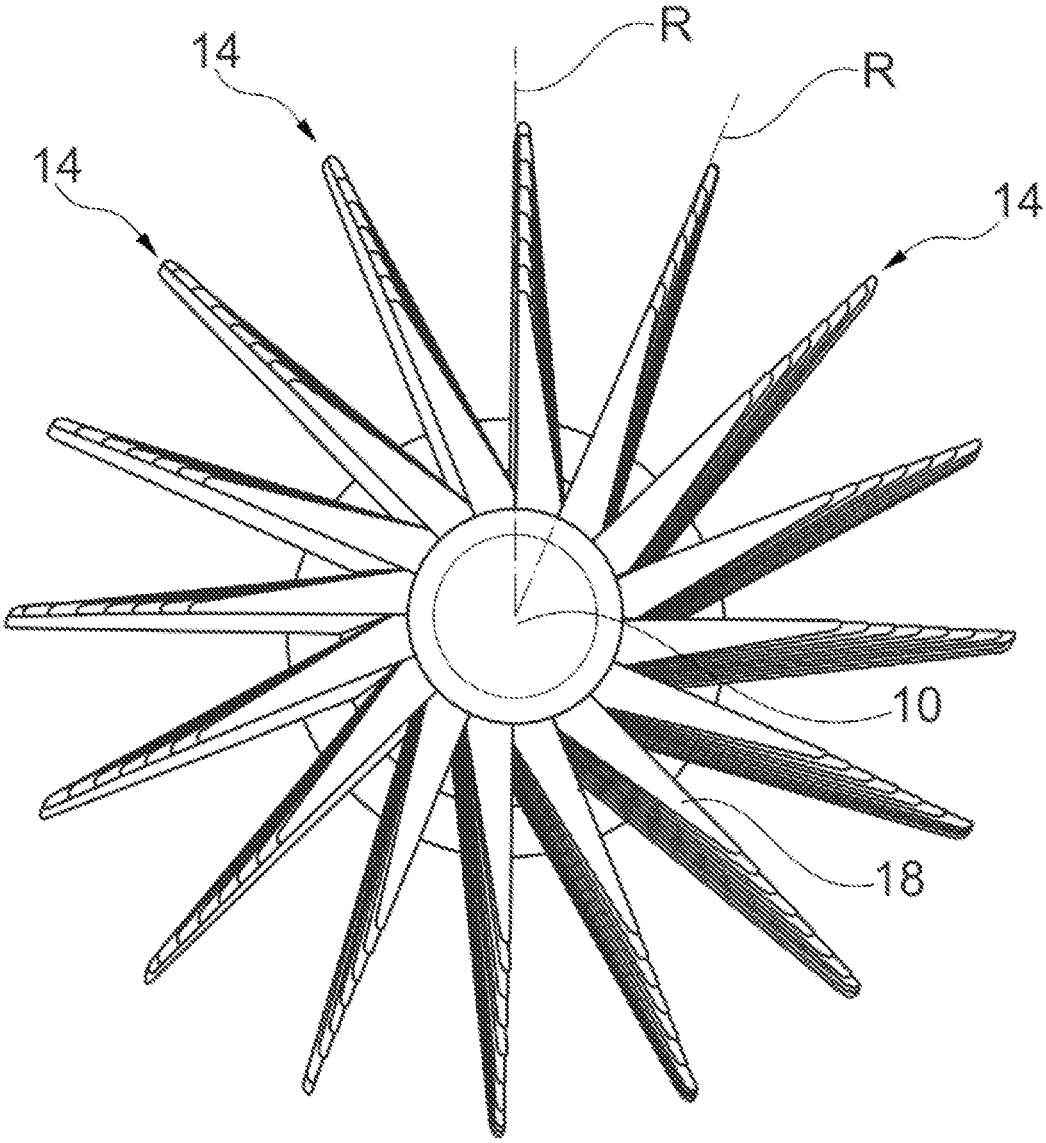
FIG. 5 is a face-on view along IV in FIG. 2.
Figure 6:
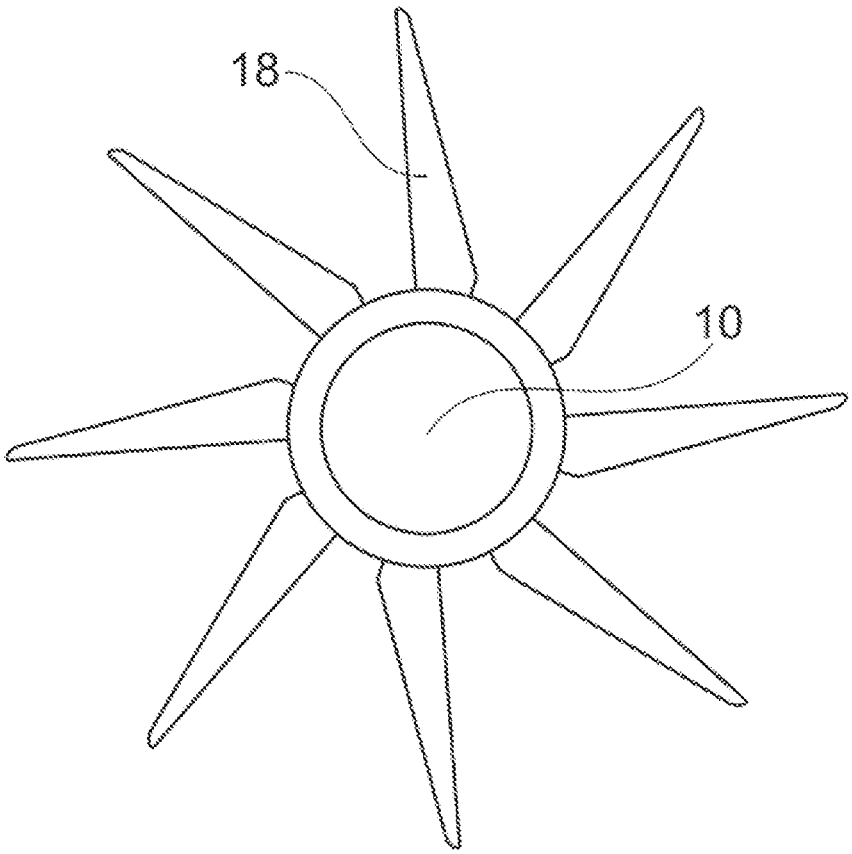
FIG. 6 is a view similar to FIG. 5, which shows only the spikes that are of the same rank and occupy the same axial position in the different rows.

In the example described, as can be seen more clearly in FIG. 5, the spikes 18 are organized in sixteen rows 14, each row 14 having for example between 15 and 30 spikes. The number of rows 14 may be different, preferably being between 15 and 20.

The height h of a spike 18, measured from its base, is for example between 2.5 mm and 4.5 mm.

The distances along the longitudinal axis Y between the tips of two consecutive spikes 18 in one and the same row 14 is for example between 0.5 mm and 0.7 mm.

Figure 7:
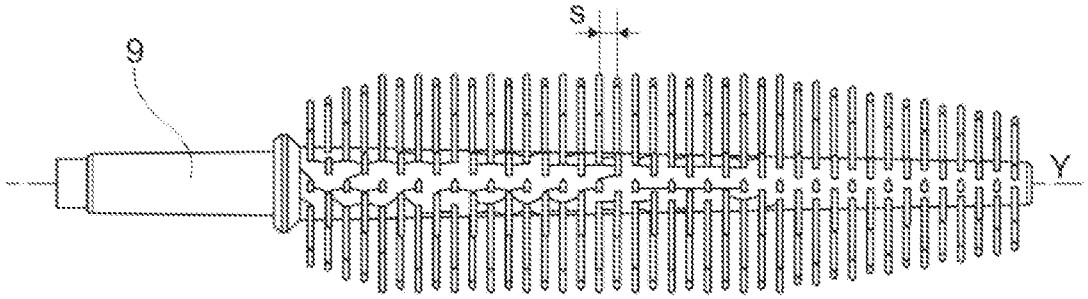
FIG. 7 is a side view along VI in FIG. 2.
Figure 8:
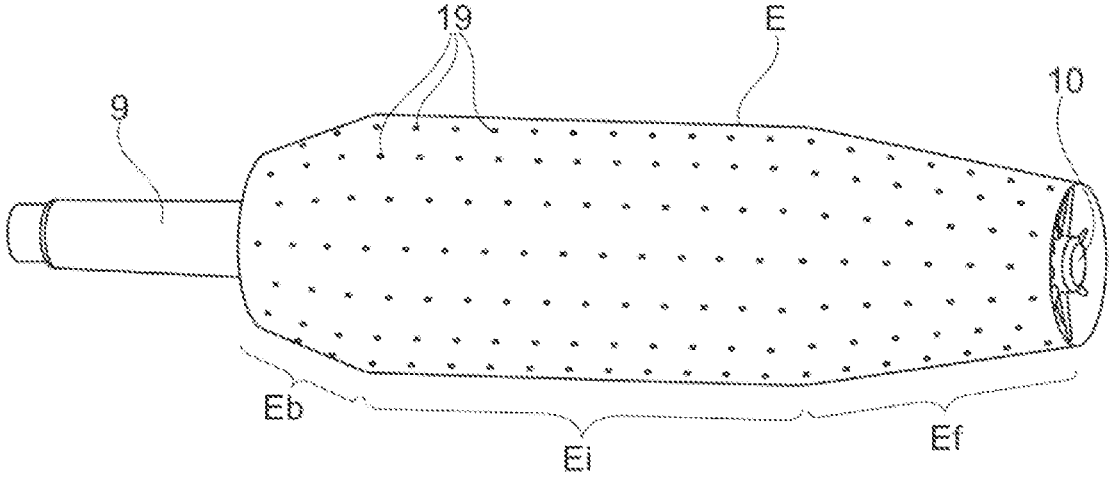
FIG. 8 shows the envelope surface of the applicator member in FIG. 2, FIG. 9 schematically shows a face-on view of a spike of the applicator member in FIG. 2, close to the distal end of the core.

The free ends 19 of the spikes 18 define an envelope surface E that has a rectilinear longitudinal axis coincident with the longitudinal axis Y of the core 10. As illustrated in FIG. 7, the envelope surface E may exhibit symmetry of revolution about said axis Y, with an elongate shape, with a circular cross section.

In the example illustrated, the envelope surface E has a front frustoconical portion Ef and a rear frustoconical portion Eb and a main portion Ei between the two, the section of which is substantially constant.

When the envelope surface E has some other shape, for example an ovoid shape, this does not constitute a departure from the scope of the invention.

Figure 3:
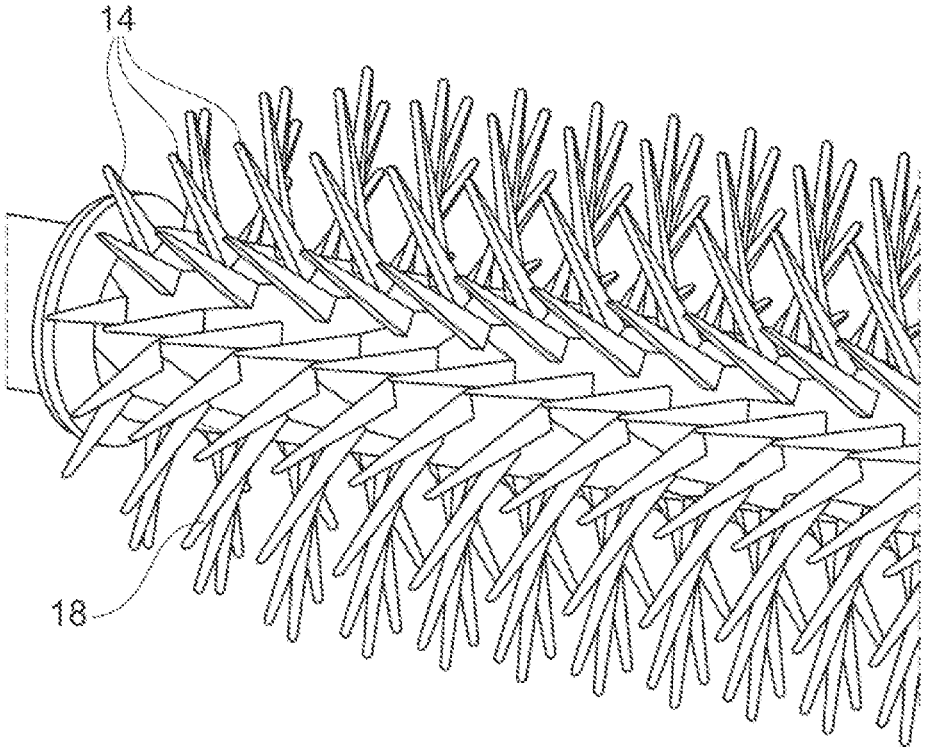
FIG. 3 shows the applicator member in FIG. 2 in more detail.

The spikes 18 in one and the same row 14 are aligned at their base on one side along an axis of alignment of the spikes which is parallel to the longitudinal axis Y of the core, as can be seen in FIG. 3 in particular, in which it can also be seen that the spikes 18 in one row 14 are disposed in a staggered manner with respect to those in the adjacent row, the spikes in one row being situated substantially half way, along the axis Y, between the spikes in the adjacent rows.

Figure 4:
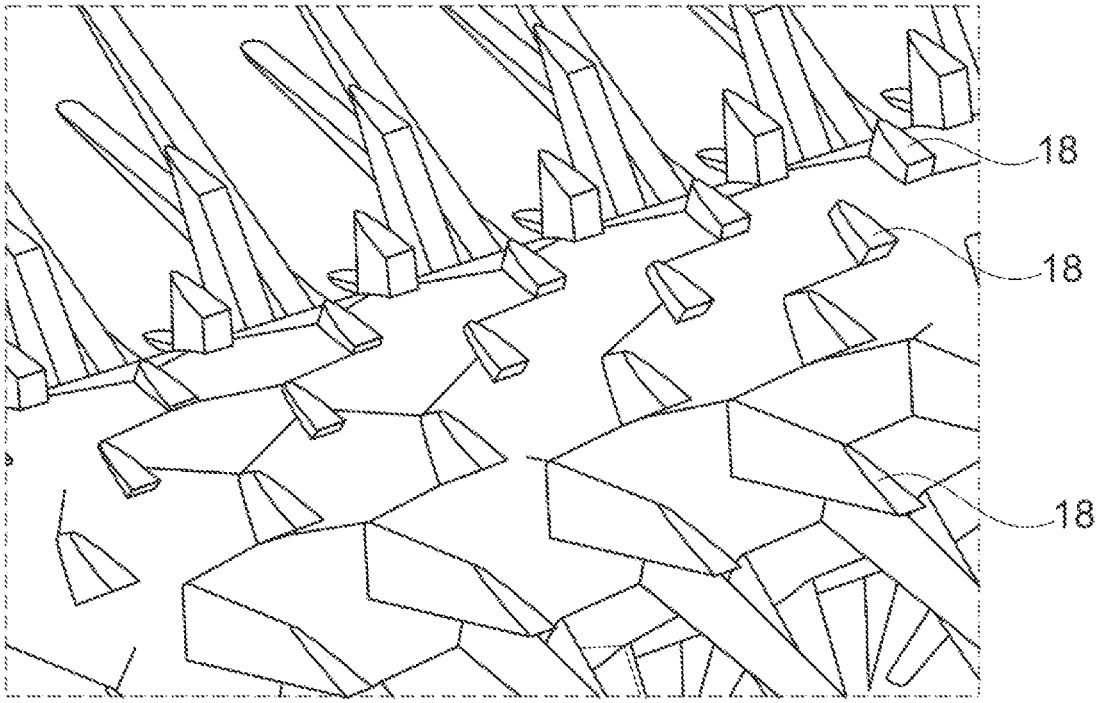
FIG. 4 is a view with a cross section through the spikes in a plane perpendicular to a radius.

In this example, the spikes 18 have a height which can vary along the row, but they maintain the same planar-convex overall shape in cross section, as illustrated in FIG. 4.

When seen in face-on view, along the longitudinal axis Y, as can be seen in FIGS. 5, 6, 9, 12 and 13 in particular, the spikes 18 have a triangular shape over virtually their entire height. Each spike 18 has a planar face 23 that defines, in face-on view, a radially extending rectilinear side 22 and a convex opposite surface that defines an opposite side 26 in face-on view.

The side 22 is attached preferably perpendicularly to the core, as illustrated in FIGS. 9, 11, 12 and 13.

The side 26 has a rectilinear portion 28 that makes an acute angle b with the side 22, which is attached to the latter at the tip of the spike 19, forming a rounded portion 24. The angle b is preferably between 5 and 10°.

Figure 9:
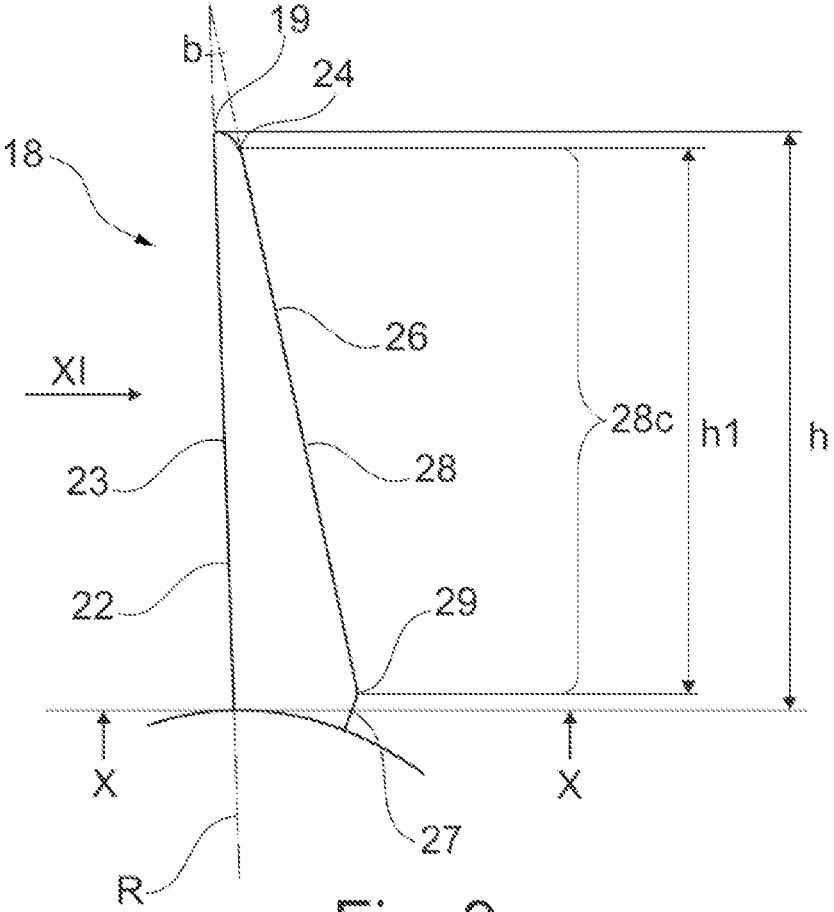

For the spikes 18 situated closest to the distal end of the core, the rectilinear side is attached at the bottom, at 29, to a steeper segment 27, which leads to the core and is oriented substantially perpendicularly thereto, as illustrated in FIG. 9. The presence of the segment 27 makes it possible to increase the gap between the spikes at their base, in the region where the diameter of the core is smallest given its conical shape.

Figure 12:
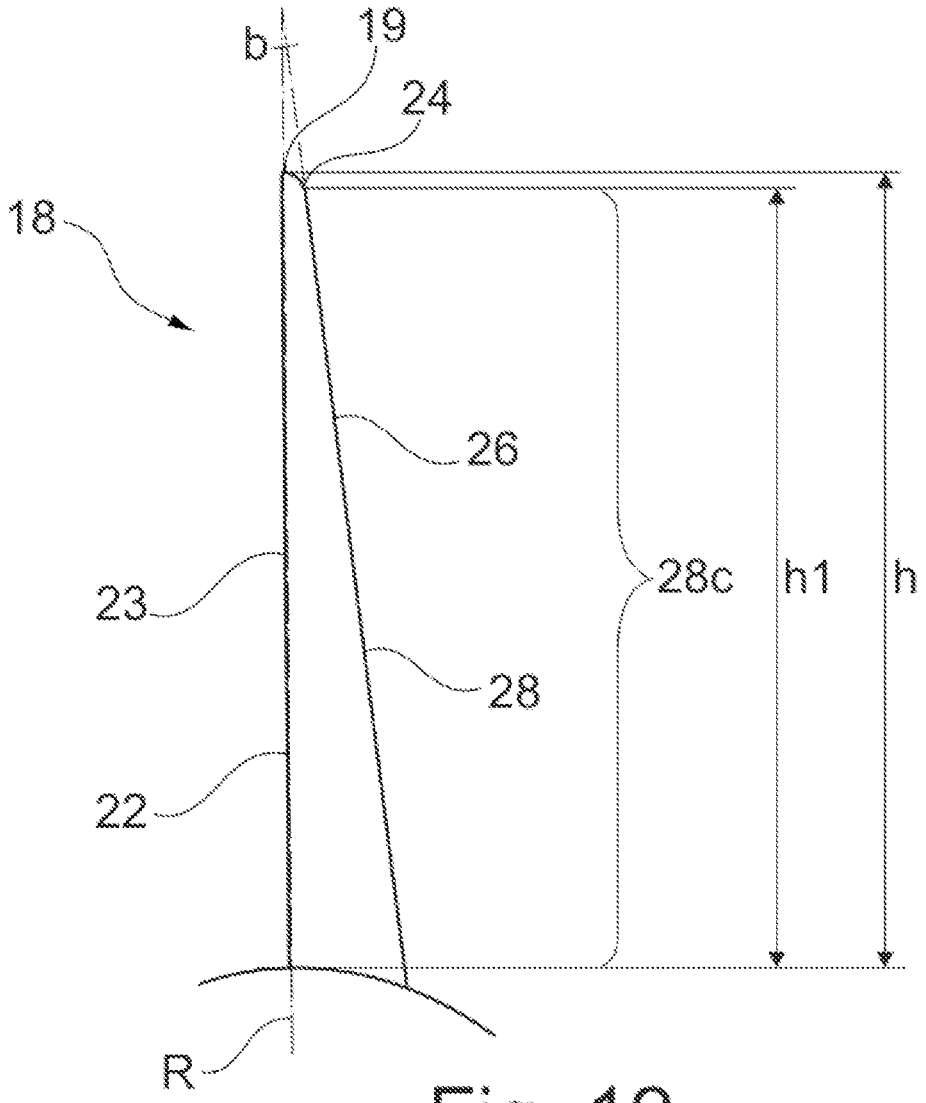
FIG. 12 is a view similar to FIG. 8 of a spike further away from the distal end of the core.

For the spikes 18 further away from the distal end of the core, the rectilinear portion 28 is attached directly to the core, as illustrated in FIG. 12.

In the example in question, all the spikes 18 in one and the same row 14 are aligned on one and the same radial plane R containing the longitudinal axis Y of the core 10 and the planar faces 23 of the spikes.

The rectilinear portion 28 defines, with the rectilinear side 22, a part 28*c* with a triangular shape, extending over a height hi that is equal, in the example in question, to at least 90% of the total height h of the spike 18.

Figure 10:
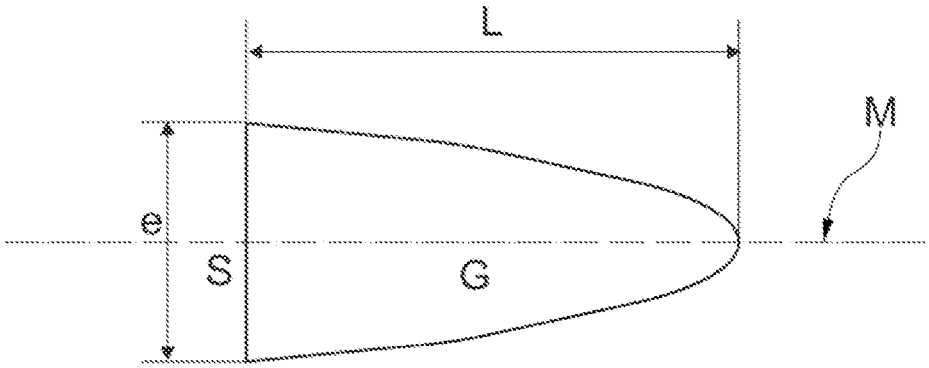
FIG. 10 is a cross section on X-X in FIG. 9.

As shown in FIG. 10, the spike 18 has, in cross section taken at its base perpendicularly to the radial plane R, an ogival shape, with a straight base, having a minor axis S parallel to the longitudinal axis Y of the core 10 and a major axis G that is perpendicular thereto.

The thickness e of the spike is measured in the direction of the longitudinal axis Y of the core, and the width L is measured in the perpendicular direction. In accordance with the invention, the ratio e/L is between 0.4 and 0.6 and, for example, equal to 0.5.

The face 23 has a width w which decreases very slightly along the spike towards its free end, being for example at least 65% of the width measured at the base at a distance c from the tip equal to 0.3 mm.

Figure 11:
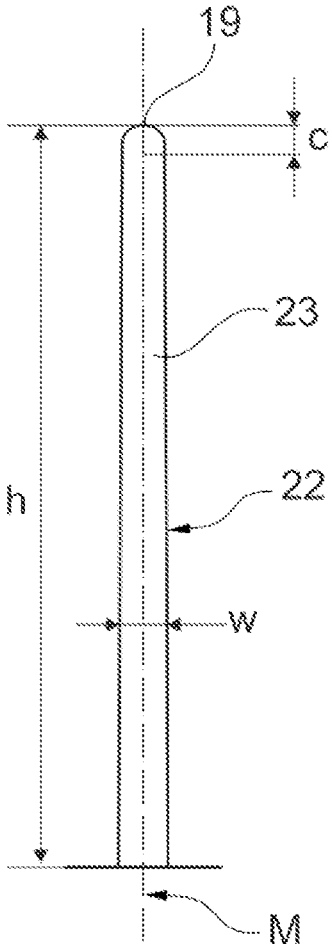
FIG. 11 is a side view, from the left-hand side, along XI in FIG. 9.

In FIGS. 10 and 11, it can be seen that the spike has a shape that is symmetric with respect to a median plane M perpendicular to the face 23.

Figure 13:
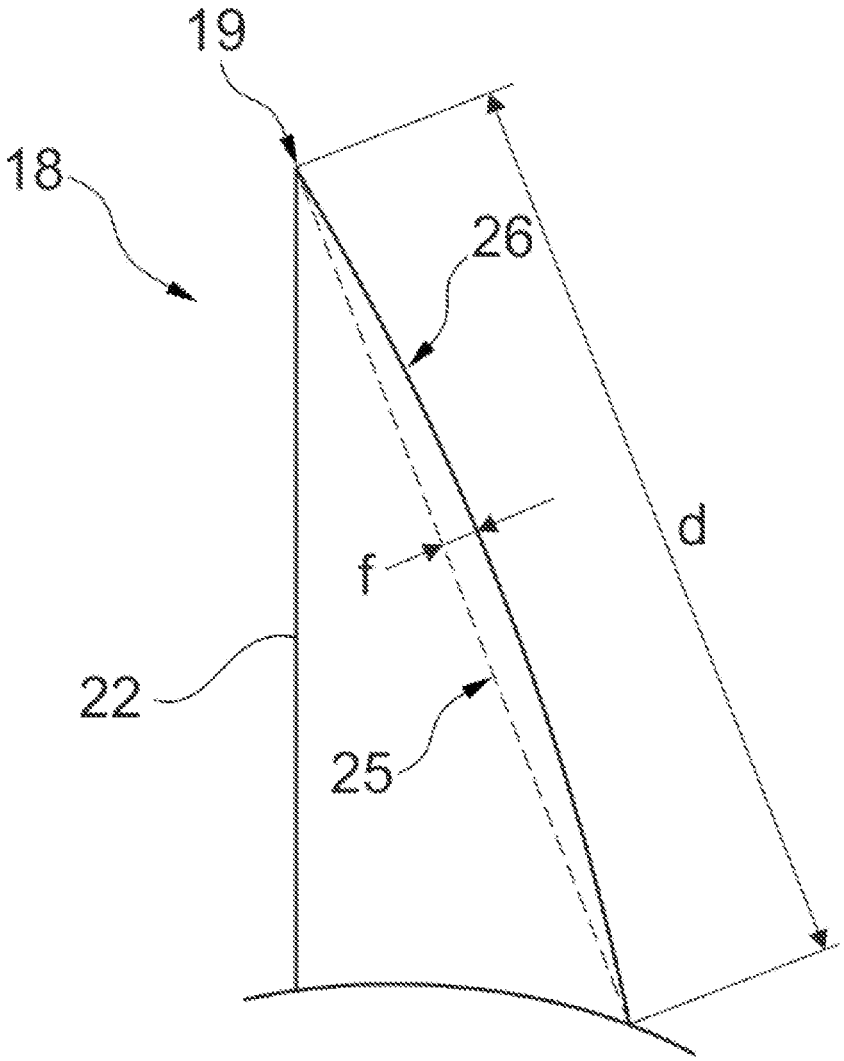
FIG. 13 is a view similar to FIG. 9, illustrating a spike variant of substantially triangular shape.

FIG. 13 is a view similar to FIG. 12 of a spike variant having an approximately triangular shape.

The side 26 has a slightly convex shape and differs from the rectilinear side 25 of a reference imaginary triangle shown by way of dashed lines by a distance f. The relative difference, defined by the ratio f/d, remains less than 10%, where d denotes the length of the rectilinear side 25.

In order to use the device 1, the user withdraws the applicator 2 from the container 3. During this operation, the spikes 18 can bend easily on account of the shape and the orientation of the section, and the wiping member can be passed through easily in a very gentle manner to the user.

During application, the spikes have sufficient mechanical integrity in the transverse direction to separate the eyelashes effectively.

The invention is not limited to the exemplary embodiments described above.

The applicator member may be manufactured with a different disposition of the spikes within the rows, for example.

The invention claimed is:

1. An applicator for applying a product to the eyelashes and/or eyebrows, having an applicator member having:

a core extending along a longitudinal axis, spikes that are carried by the core, have, in face-on view when viewed along the longitudinal axis of the core, a substantially triangular shape over at least 50% of their height, with a side that is oriented substantially radially, and have a cross section at the base of the spike taken perpendicularly to this side, satisfying the relationship e/L of between 0.4 and 0.6, where e denotes the thickness of the section measured in the direction of the longitudinal axis of the core and L denotes the width of the section measured in a direction perpendicular to the longitudinal axis of the core, the substantially triangular shape of the spikes being triangular or approximately triangular, with sides that differ from those of an imaginary triangle that is most similar by a relative difference that is less than 10%, this relative difference being defined by the ratio f/d, f denoting the distance between the side of the approximate triangle which extends obliquely and that of the similar imaginary triangle which extends obliquely, and d denoting the length of the corresponding side of the similar imaginary triangle.

2. The applicator according to claim 1, wherein said ratio e/L is between 0.45 and 0.55.

3. The applicator according to claim 1, wherein the thickness e is between 0.2 mm and 0.3 mm.

4. The applicator according to claim 1, wherein the width L is between 0.5 mm and 0.75 mm.

5. The applicator according to claim 1, wherein the spikes have, at their base, a cross section of convex shape around at least a part of their perimeter with a planar side and an opposite side of convex shape.

6. The applicator according to claim 1, wherein the spikes have, at their base, a cross section of ogival shape.

7. The applicator according to the claim 6, wherein the cross section has a straight base parallel to the longitudinal axis of the core.

8. The applicator according to claim 1, wherein the height of the spikes is between 2.5 mm and 4.5 mm.

9. The applicator according to claim 1, wherein said substantially triangular shape corresponds to at least 75%.

10. The applicator according to claim 1, wherein the spikes have a substantially planar face, parallel to the longitudinal axis of the core, which extends substantially radially, this face defining the side, extending radially in face-on view, of the spike.

11. The applicator according to claim 1, wherein the base of the spikes is at an angle of between 5° and 10° as seen from the tip thereof.

12. The applicator according to claim 1, wherein said substantially triangular shape has an inclined side attached to the core by a portion with a steeper gradient.

13. The applicator according to claim 1, wherein the spikes have a triangular shape over at least 50% of their height in face-on view when viewed along the longitudinal axis of the core.

14. The applicator according to claim 1, wherein the spikes in one and the same row are at least partially superposed in face-on view.

15. The applicator according to claim 1, wherein, with the spikes being disposed in rows, the spikes in one row are disposed in a staggered manner with respect to those in the adjacent row.

16. The applicator according to claim 1, wherein the distance along the longitudinal axis of the core between two consecutive spikes in one and the same row is between 0.5 mm and 0.7 mm.

17. The applicator according to claim 1, wherein the longitudinal axis of the core is rectilinear.

18. A packaging and application device having an applicator as defined in claim 1 and a container containing the product to be applied.

19. A method for making up and/or caring for the eyelashes and/or eyebrows, involving the application to the eyelashes and/or eyebrows of a product by means of the applicator of the device as defined in claim 18.

* * * * *